United States Patent [19]

Corella

[11] 4,115,909

[45] Sep. 26, 1978

[54] REINFORCING INSERT FOR COLLAPSIBLE PACKAGES

[76] Inventor: Arthur P. Corella, 8166 Vanscoy Ave., North Hollywood, Calif. 91602

[21] Appl. No.: 853,122

[22] Filed: Nov. 21, 1977

Related U.S. Application Data

[63] Continuation-in-part of Ser. No. 717,097, Aug. 24, 1976, abandoned.

[51] Int. Cl.[2] ..... B65D 5/42

[52] U.S. Cl. ..... 229/48 R; 93/1.1; 138/128; 220/76; 229/22; 229/55; 428/57

[58] Field of Search ..... 217/65; 220/4 F, 76; 229/55, 22, 48 R, 30, 35; 93/1.1; 138/128, 163, 157, 120; 428/33, 57

[56] References Cited

U.S. PATENT DOCUMENTS

| | | | |
|---|---|---|---|
| 88,165 | 3/1869 | Hendryx | 229/30 |
| 383,175 | 5/1888 | Gardner | 229/48 R |
| 595,494 | 12/1897 | O'Meara | 220/76 |
| 828,899 | 8/1906 | Parker | 220/76 |
| 896,600 | 8/1908 | Thornton | 229/48 R |
| 3,666,607 | 5/1972 | Weissman | 229/22 |

*Primary Examiner*—Stephen P. Garbe
*Attorney, Agent, or Firm*—Donald Diamond

[57] ABSTRACT

A cardboard insert for reinforcing collapsible packages, such as see-through plastic bags, is formed from a one-piece blank in which a number of panels are separated by score lines. The panels are sized and shaped to define the desired form, generally a right paralleliped, and the mating edges of the insert blank are pre-slit - and alternate tabs bent inward to form interlocking fingers. The interleaved projecting tabs define a locked seam which is, additionally, reinforced by the adjoining inward-bent tabs. The seam is formed by bending the several panels along the score lines to form the finished shape of the insert, and interleaving the projecting tabs of the free edges.

12 Claims, 10 Drawing Figures

REINFORCING INSERT FOR COLLAPSIBLE PACKAGES

CROSS-REFERENCE TO RELATED APPLICATION

This application is a continuation-in-part of U.S. patent application Ser. No. 717,097 filed on Aug. 24, 1976 and entitled Reinforcing Insert For Collapsible Packages now abandoned.

BACKGROUND OF THE INVENTION

The instant invention relates to inserts for flexible packages. It relates, more particularly to package inserts adapted to define the shapes of — and impart rigidity to — flexible, collapsible bags.

Collapsible bags of thin membraneous materials, chiefly plastics, are extensively employed for packaging purposes in diverse fields. Such packages are economical, readily stored in small volumes, generally transparent so as to permit inspection of the contents, may be imprinted with informative and advertising messages, and in general extremely desirable for many retail applications, particularly in the field of food packaging.

The greatest difficulty in the use of such flexible bags stems from their inherent lack of compressive strength; they do not readily maintain any given shape and tend to deform into the most efficient structural form, most commonly a sphere, adapted to their dimensions and the nature of their contents. As a consequence, such packages cannot be readily applied to granular materials — flour, sugar, grain kernels and the like — unless a lumpy appearance is compatible with the ultimate use. Thin-walled bags are also inherently inapplicable to contents with sharp edges and rigid in nature, due to the danger of puncturing the bag material.

Many forms of rigid and semi-rigid inserts have been proposed in the art: mainly to impart a definite outline to the composite package; to protect the package from puncture; to allow the bases of such packages to accept loads without tearing; and to permit stacking of filled packages. None of the proposed inserts are readily adapted to general use — since they are formed for specific purposes and to support defined shapes — and most make use of three-dimensional insert structures which must have at least one seam pre-glued or stapled.

It is, therefore, a primary object of the invention to teach the construction and use of inserts capable of securing a rigid shape for flexible package bags, which do not require any joining operations prior to use, and which may be stored in the form of flat blanks or prefolded shapes and assembled at the point of use.

It is a further object of the invention to provide an insert which may be readily expanded manually, or automatically, in a flexible bag which forms the external sheath of the package with the insert and which, upon such expansion, forms a reinforced seam at the confluence of the free edges in the initial blank.

It is also an object of the invention to provide blanks for the forming of package inserts which are slit and formed at their free edges to define alternating straight and bent tabs in a crenellated structure readily interleaved into a self-supporting seam.

PRIOR ART

U.S. Pat. No. 88,165 (Hendryx, 1869) discloses a paper box wherein one side of a conjoint edge is provided with tails or tabs which extend beyond the edge or seam line and the other side is provided with recesses which depend inwardly from the edge or seam line such that the tails or tabs are bent around and into the recesses. As shown by the drawings of Hendryx, the projecting tabs are bent at about a right angle with respect to their adjoining facet to engage the recesses in the matable edge.

U.S. Pat. No. 896,600 (Thornton, 1908) discloses a cardboard box wherein adjoining edges are cut to define a number of flat projections and recesses of interlocking dovetail shape and the projections, on their inner sides, are scored, bent or creased to cause them to bend at right angles intermediate of their length so that when the edges are brought together the two sets of projections lie in the same flat plane (with reference to their respective mating recesses) and the ends of the projections fit into the corresponding recesses.

SUMMARY

The objects of this invention, and other objects and advantages which will become apparent from the detailed description of the preferred embodiment thereof, are attained by providing a blank of cardboard — or similar rigid or semi-rigid sheet material — whose outline corresponds to the developed surface of the final insert, and whose surface is provided with scorelines to define the several facets of the finished insert.

Those edges of the blank which are to meet at some, or all, of the conjoint intersections of the folded structure, are slit at intervals — generally uniform in spacing — in such a manner that the slits align upon the folding of the blank into the finished shape of the insert. Alternating tabs at each confronting edge of the blank are bent, to form crenellated structures adapted to be interlocked by pressing the projecting tabs over the bent tabs of the mating edge.

While the invention is applicable to any geometric shape which can be developed into a single flat plane and defined by planar facets adjoined at linear edges — the general class of polyhedra in geometry — it is foreseen that the majority of commercial applications shall be selected from a few simple shapes: cubes, right parallelipeds, triangular and pentagonal prisms, and the like.

It is also foreseen that the insert of the invention will generally be delivered to the point of use in the form of pre-cut, scored, and pre-slit blanks with the bent tabs of the edges partially deformed toward, or wholly deformed into, their ultimate configurations. The partial deformation of such tabs has the practical advantage that — in geometric configurations demanding tabs bent at right angles — partly bend tabs permit the nesting of the blanks, where fully bent tabs would not.

In many instances it will be sufficient to provide an insert defining the circumference only of the final package; in other words an insert without a base or a cover flap. In other uses the provision of a bottom and/or top will also be required.

Whenever a base, or a top, facet is to be part of the final insert a plurality of potentially interlocked seams will arise, and a decision will have to be made as to which of these seams is to be provided with interlocking tabs. In the case of rectangular prisms, including cubes, the base will fold away from one of the sides and is suitably interlocked with the other three base edges, or only the opposing one.

Thus, in accordance with one aspect of this invention, there is provided a reinforcing insert for flexible packaging, formed from a single blank, which comprises a plurality of facets, each corresponding to a panel in said blank; a plurality of fold lines, each corresponding to a score line in said blank for defining said panels; and a plurality of alternating projecting tabs and intervening spaces in each of matable edges of at least two of said facets, said tabs being substantially straight and substantially rectangular and said spaces being substantially rectangular, said tabs and spaces being so conformed that the tabs in one of said matable edges substantially dimensionally correspond to the spaces in the other of said matable edges, whereby the projecting tabs in the matable edges may be interleaved to form a seam, with each of the projecting tabs forming said seam being substantially unbent and substantially in the same plane as its adjoining facet and the outer ends of the projecting, unbent tabs demarcating said seam.

In accordance with a second aspect of this invention, there is provided a method for producing reinforcing inserts for flexible packaging from a sheet of cardboard or the like, comprising the steps of: developing on the surface of said sheet the outline for a plurality of facets defining said insert; cutting the developed outline from the sheet, and scoring fold lines thereon for defining said facets; slitting each of matable edges of at least two outboard facets of the insert, to define laterally projecting substantially straight and substantially rectangular tabs; bending alternate ones of said projecting tabs out of the plane of its facet such that the bent and unbent tabs in the mating edge of one facet are out of phase with respect to the bent and unbent tabs in the mating edge of the other facet; and folding said sheet along said score lines and interleaving said projecting tabs at said matable edges to form a conjoint edge, with each of the unbent projecting tabs being substantially in the same plane as its adjoining facet and the outer ends of the projecting, unbent tabs demarcating the conjoint edge.

Alternative forms and embodiments of the invention will be described below, adapted to differing uses. In general the insert of the invention is particularly adapted to mechanized packaging systems where the blank may be cut, scored, slit and bent in a subsidiary machine and, thereafter, mated with the bag automatically, and expanded therein by a suitable servomechanism.

DESCRIPTION OF THE DRAWINGS

The preferred embodiment of the invention is illustrated in the accompanying drawings, wherein.

DESCRIPTION OF THE PREFERRED EMBODIMENT

Figure 1:
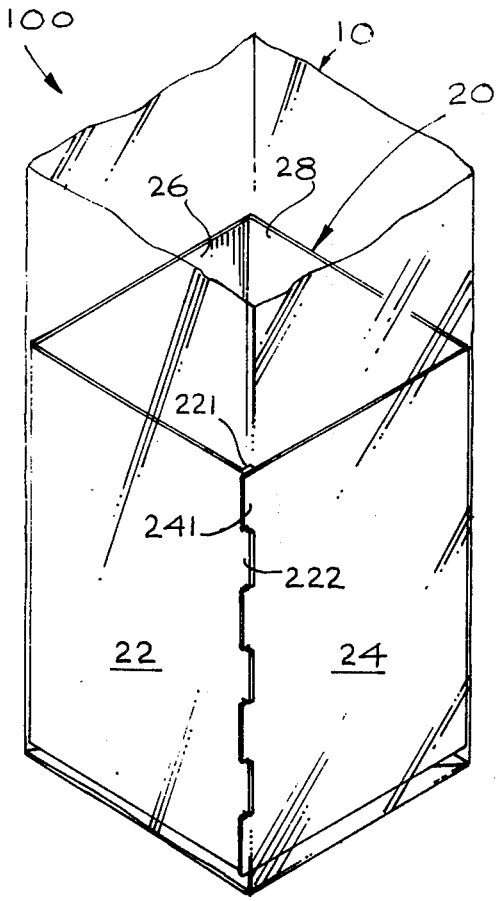
FIG. 1 is a perspective view of a rectangular package of flexible plastic with a stiffening insert of the invention.

The perspective view of FIG. 1 shows a package 100 comprised of an external sheath 10 and a cardboard insert 20. The sheath 10 is basically a tubular plastic bag, the base of which is folded and sealed to define a substantially square base for a right prismoidal package.

The insert 20 is defined by panels 22, 26, 28 and 24 — reading clockwise around the periphery of the insert in the projection of FIG. 1 — with each panel substantially defining one side of the package 100 upon closure of the top.

Rectangular tabs project from panels 22 and 24 and are interleaved to form a rigid seam at the boundary between these panels; a typical topmost tab 241 projecting from the panel 24 being adjoined by a tab 222, for example, projecting from panel 22.

Figure 2A:
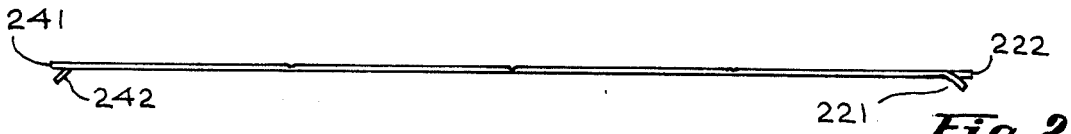
FIG. 2*a* and FIG. 2*b* are, respectively, frontal and planar aspects of the blank from which the insert employed in the embodiment of FIG. 1 is formed.
Figure 2B:
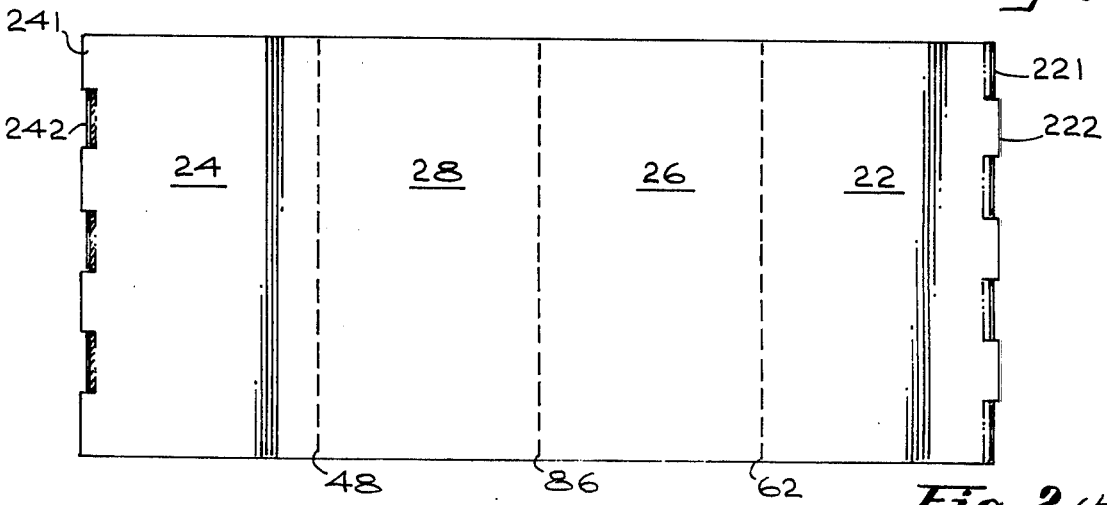

The insert 20 is also shown in the form of a blank in FIGS. 2*a* and 2*b*. The planar view of FIG. 2*b* clearly shows score lines 48, 86 and 62 defining the four panels on the blank. The two center panels 28 and 26, separated by score line 86, are of equal width. The outer panels 24 and 22 are slightly wider than the center ones to accommodate the lateral dimensions of the tabs formed in their edges by slitting the material of the blank. The topmost tab 241 is shown projecting from the blank, while a similar tab 242 immediately adjoining tab 241 is shown bent with respect to the plane of the blank.

At the far edge of the blank, projecting from the panel 22, a tab 222 is shown at an elevation corresponding to tab 242. A tab 221 directly above the tab 222 is shown bent with respect to the plane of the blank.

While the bent tabs of the package inserts of this invention may be extensively bent up to, for example, 90°, they are, advantageously, bent or inclined at a shallower angle such as between about 30° and about 60° with respect to the plane of the blank.

The alternating projecting and bent tabs at the outboard extremities of the end panels 22 and 24 are out of phase when the two sets of crenellations are brought into juxtaposition during the formation of the insert 20.

The projecting and bent tabs of the blank are formed by slits at equal spacing relative one to the other, consequently the seams defined by them are readily formed by pressing each projecting blank over the corresponding bent tab in the mating edge. In the resulting assembly the bent tabs adjoin the bases of the projecting ones, reinforcing the seam against forces tending to collapse the insert, or to expand it from within.

Figure 3:
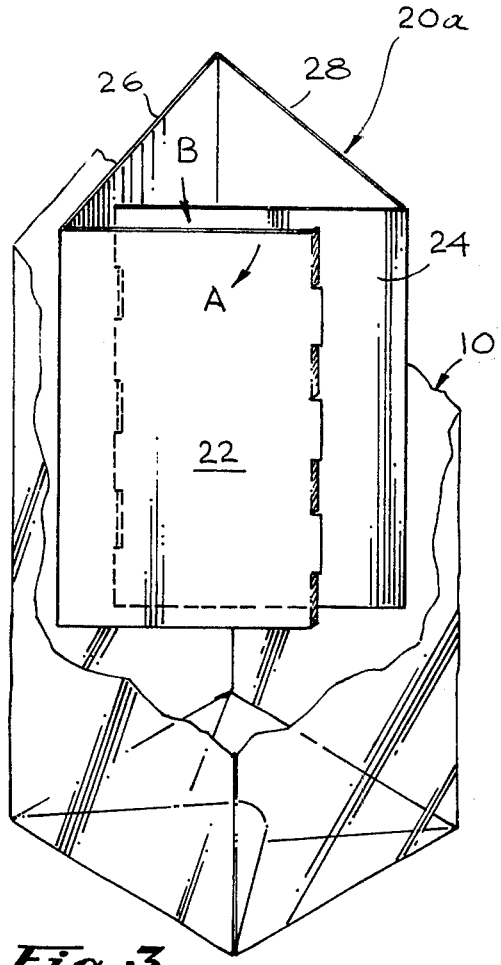
FIG. 3 is a perspective view of the insert blank of FIGS. 2*a* and 2*b*, partly folded for mating with the bag with which it co-operatively defines the stiffened package of FIG. 1.

The persepctive view of FIG. 3 illustrates an intermediate stage in the formation of the package 100 from the bag 10 and the insert blank. The latter is shown prefolded into a pre-form 20*a*, substantially triangular in shape and with the panels 22 and 24 substantially overlapping.

The pre-form 20*a* is lowered into the bag 10 by utilizing the diagonal dimension of the latter to accommodate the folded panels 22 and 24. Once in position, the pre-form 20*a* is opened out and the seam formed as described hereinabove, by pressing the projecting tabs into the mating sockets of the opposing edge.

Figure 4:
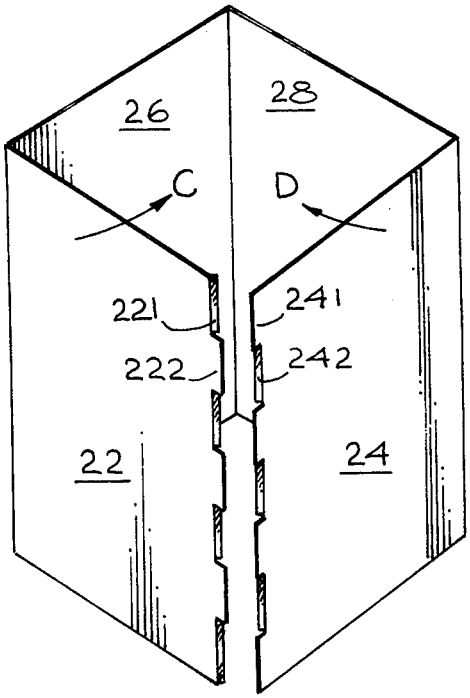
FIG. 4 is a perspective view of the insert of FIG. 1 in the penultimate stage of assembly.

FIG. 4 illustrates the penultimate stage in the formation of the insert 20. The pre-form 20*a* has been opened to a dimension slightly larger than the finished insert so that the tips of the opposing arrays of projecting tabs may be passed over each other, prior to reclosure — in the sense of arrows C and D — and the fastening of the finished seam.

Figure 5:
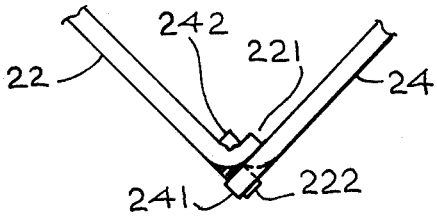
FIGS. 5, 6, 7 and 8 are partial views of four different forms of the interleaved seams which may be defined by the slit tabs of the insert blank of the invention.

FIG. 5 is a partial view of the closed seam of the insert 20; formed with the projecting tabs 241 and 222, and inward bent tabs 221 and 242. The tabs 221 and 241 immediately adjoin the upper edge of the insert 20 — or the blank or preform 20*a* — while the tabs 222 and 242 are displaced one slit spacing downwardly from them.

Figure 6:
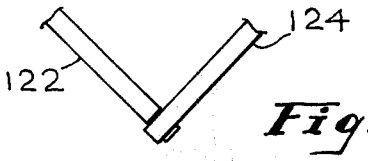

FIG. 6 is an analogue of FIG. 5 and illustrates the simplest form of the reinforced seam of the insert of the invention. In this form the inwardly bent tabs — the equivalents of tabs 221 and 242 — are omitted and the projecting tabs of panels 122 and 124 form the seam directly. The corresponding blank is formed not by slitting but by diecutting, with the material corresponding to the bent tabs of FIG. 5 removed in the course of that operation.

The embodiment of FIG. 6 is particularly advantageous for employment with automatic insert-forming machinery, since the expanded position of FIG. 4 may be omitted and the tips of the projecting tabs along one panel, such as panel 122, may be slid along the internal face of the opposing panel, 124 in the illustration. The resulting seam is somewhat weaker due to the absence of the reinforcement provided by the bent tabs which abut the inside of the finished insert structure.

Figure 7:
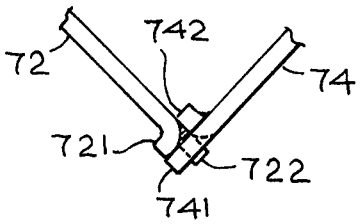

FIG. 7 is yet another analogue to FIG. 5, showing a composite structure in which the alternate tabs on one panel, panel 74, are bent inwardly, while the out of phase tabs on panel 72 are bent outwardly, with respect to the volume defined by the finished insert. This embodiment attains most of the reinforcing properties inherent in the retention of bent tabs and also permits the sliding of the projecting tabs of panel 74 along the inner face of panel 72, without interference from the inwardly projecting tabs of FIG. 5.

Figure 8:
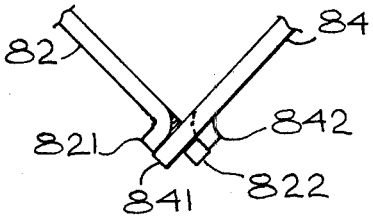

A further development of the edge configuration of the package insert is shown in the fragmentary view of FIG. 8. In this illustration both sets of alternate tabs, along the edges of panels 82 and 84, are shown bent outwardly from the corner seam. In the resulting structure an outwardly bent tab 821 adjoins a projecting tab 841 - forming part of the panel 82 and 84, respectively — while immediately below a bent tab 842 adjoins a projecting tab 822.

The configuration of FIG. 8 is especially adapted to machine expansion — for example by the insertion of an expandable rubber bag into the pre-form 20*a* or its equivalent and the pressurization of same with a compressed fluid. It also provides for a very strong insert in relation to collapsing forces applied from the outside of the finished package.

Figure 9:
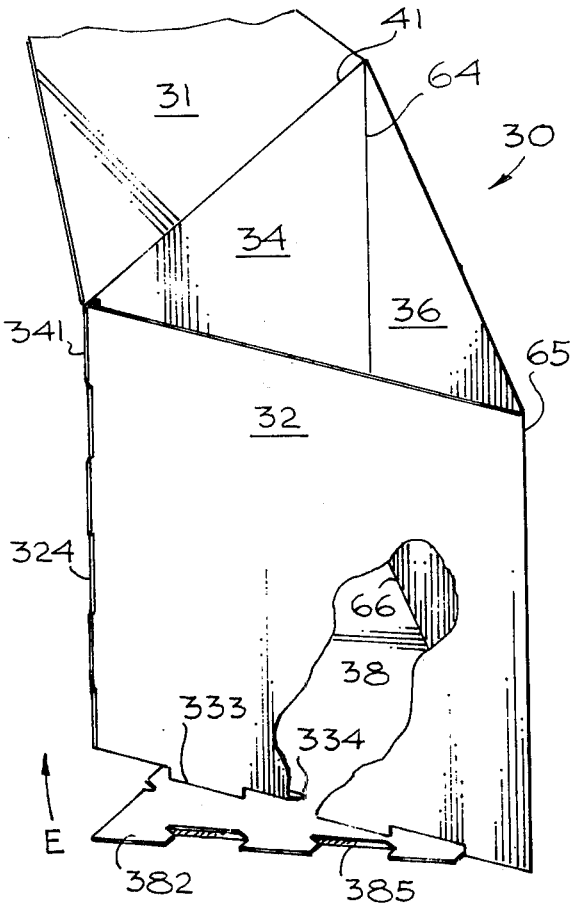
FIG. 9 is a perspective view of an insert in the form of a triangular prism and provided with base and top facets.

The perspective view of FIG. 9 illustrates a complex insert 30 in the form of a triangular prism, whose base is defined by a panel 38. The finished insert 30 is based on an equilateral triangle and its three sides are represented by panels 32, 34 and 36.

The seams of the insert 30 are defined by arrays of projecting tabs, typically tabs 341, 324, 382 and 333 and by inwardly bent tabs, typically 385 and 334.

The base panel 38 depends from the back panel 36 and is delimited therefrom by a seam 66. Both free edges of the panel 38 are provided with the crenellated seam-forming tabs of the invention and mate with corresponding basal edges in the panels 32 and 34.

A cover plate 31 completes the insert 30; the cover projecting from side panel 34 and hinging on a scoreline 41. Additional score lines 64 and 65 demarcate the side panels 32 and 34 from the back panel 36.

While in the foregoing description and accompanying drawing there has been shown and described the preferred embodiment of this invention, it will be understood, of course, that minor changes may be made in the details of construction as well as in the combination and arrangement of parts without departing from the spirit and scope of the invention as claimed.

That which is claimed is:

1. A reinforcing insert for flexible packaging, formed from a single blank, comprising:

a plurality of facets, each corresponding to a panel in said blank;

a plurality of fold lines, each corresponding to a score line in said blank for defining said panels; and a plurality of alternating projecting tabs and intervening spaces in each of matable edges of at least two of said facets, said tabs being substantially straight and substantially rectangular and said spaces being substantially rectangular, said tabs and spaces being so conformed that the tabs in one of said matable edges substantially dimensionally correspond to the spaces in the other of said matable edges, said projecting tabs in the matable edges being interleaved to form a seam, with each of the projecting tabs forming said seam being substantially unbent and substantially in the same plane as its adjoining facet and the outer ends of the projecting, unbent tabs demarcating said seam.

2. The insert of claim 1, wherein said insert is formed from semi-rigid sheet material.

3. The insert of claim 2, wherein said sheet material is paperboard.

4. The insert of claim 1, wherein said plurality of facets define a regular polyhedron.

5. The insert of claim 4, wherein said polyhedron is selected from facets defined by parallel fold lines.

6. The insert of claim 5, wherein said polyhedron is a right paralleliped.

7. The insert of claim 5, wherein said polyhedron is a triangular prism.

8. The insert of claim 1, wherein said projecting tabs in the matable edges are formed by parallel, spaced slits in said edges, with said slits being at right angles to the edges.

9. The insert of claim 8, wherein the material intervening between said projecting tabs is bent away from the plane of said facet.

10. The insert of claim 9, wherein said intervening materials is bent inwardly with respect to the outline of said insert.

11. The insert of claim 9, wherein the material intervening between said projecting tabs is bent outwardly with respect to the outline of said insert.

12. A method for producing reinforcing inserts for flexible packaging from a sheet of cardboard or the like, comprising the steps of:

developing on the surface of said sheet the outline for a plurality of facets defining said insert;

cutting the developed outline from the sheet, and scoring fold lines thereon for defining said facets;

slitting each of matable edges of at least two outboard facets of the insert, to define laterally projecting substantially straight and substantially rectangular tabs;

bending alternate ones of said projecting tabs out of the plane of its facet such that the bent and unbent tabs in the mating edge of one facet are out of phase with respect to the bent and unbent tabs in the mating edge of the other facet; and folding said sheet along said score lines and interleaving said projecting tabs at said matable edges to form a conjoint edge, with each of the unbent projecting tabs being substantially in the same plane as its adjoining facet and the outer edge of the projecting, unbent tabs demarcating the conjoint edge.

* * * * *